US006726581B2

(12) United States Patent
Muller

(10) Patent No.: US 6,726,581 B2
(45) Date of Patent: Apr. 27, 2004

(54) UNITARY BROADHEAD BLADE UNIT AND FERRULE FOR SAME

(76) Inventor: Philip Muller, 6 Terrapin La., Mercerville, NJ (US) 08619

( * ) Notice: Subject to any disclaimer, the term of this patent is extended or adjusted under 35 U.S.C. 154(b) by 322 days.

(21) Appl. No.: 09/922,550

(22) Filed: Aug. 4, 2001

(65) Prior Publication Data

US 2003/0159683 A1 Aug. 28, 2003

Related U.S. Application Data

(60) Provisional application No. 60/265,114, filed on Jan. 31, 2001, provisional application No. 60/293,307, filed on Apr. 24, 2001, and provisional application No. 60/286,030, filed on Apr. 24, 2001.

(51) Int. Cl.[7] ..... F42B 6/08
(52) U.S. Cl. ..... 473/583; 473/584
(58) Field of Search ..... 473/583, 584

(56) References Cited

U.S. PATENT DOCUMENTS 2,930,620 A * 3/1960 Brooks
4,505,482 A * 3/1985 Martin
5,018,747 A * 5/1991 Brown
5,137,282 A * 8/1992 Segar et al.
5,192,081 A * 3/1993 Cooper
RE34,397 E * 10/1993 DelMonte et al.
5,494,298 A * 2/1996 Maleski
5,636,846 A * 6/1997 Tinsley ..... 473/584

* cited by examiner

*Primary Examiner*—John A. Ricci
(74) *Attorney, Agent, or Firm*—Pepper Hamilton LLP

(57) ABSTRACT

A unitary, chisel-type blade unit for a broadhead comprising multiple blades each with a razor edge extending radially from a common frontal point to a base. The base of each blade is connected to a central base collar having a central aperture in alignment with a cap on the underside of each of the blades and positioned between the central base collar and the common frontal point. The cap includes a structure for connection to a ferrule. The central base collar includes a structure for connection to a ferrule. The ferrule has a front portion, a central portion and a rear portion. The front portion includes a structure for connection to a cap. The central portion includes a structure for connection to the central base collar. The rear portion includes a structure for connection to an arrow shaft. The ferrule may be trimmed to remove weight therefrom.

35 Claims, 11 Drawing Sheets

UNITARY BROADHEAD BLADE UNIT AND FERRULE FOR SAME

CROSS-REFERENCE TO RELATED APPLICATIONS

This application is based upon Provisional Patent Application Serial No. 60/265,114 filed Jan. 31, 2001. This application is also based upon Provisional Patent Application Serial No. 60/293,307 filed Apr. 24, 2001. This application claims priority to Provisional Application Serial No. 60/286,030 filed Apr. 24, 2001.

BACKGROUND OF THE INVENTION

1. Field of the Invention

This invention relates to broadhead hunting arrows and more particularly to a unitary, chisel-type blade unit for a broadhead which is connectable to the shaft of an arrow by a ferrule. The construction of this broadhead allows for cut on contact action upon impact with the prey. These broadheads are weight adaptable simply by choosing different weight ferrules. The ferrule can be trimmed to remove additional weight therefrom.

2. Discussion of the Related Art

There are many broadheads disclosed in the prior art. These are made of multiple pieces fitting together to form the broadhead unit which is then attached to the shaft of an arrow. The resulting broadhead can be disassembled into the component parts, including usually the individual blades, a tip, a ferrule of some sort and other connecting parts. Examples of these multi-piece broadheads are found in U.S. Pat. No. 2,940,758 issued to Richter; U.S. Pat. No. 4,928,969 issued to Nagatori; U.S. Pat. No. 4,643,435 issued to Musacchia; U.S. Pat. No. 4,210,330 issued to Kosbab; U.S. Pat. No. 4,175,749 issued to Simo; U.S. Pat. No. 6,045,468 issued to Tinsley, et al.; U.S. Pat. No. 4,944,520 issued to Fingerson, et al.; U.S. Pat. No. 4,570,941 issued to Saunders; U.S. Pat. No. 5,494,297 issued to Maleski; U.S. Pat. No. 4,036,499 issued to Sherwin; U.S. Pat. No. 5,496,043 issued to Ester; and U.S. Pat. No. 5,931,751 issued to Cooper.

For example, U.S. Pat. No. 2,940,758, issued to Richter, discloses a broadhead having a central body with grooves to removeably receive multiple blades. In use, a pointed tip screws onto the central body and captures the front tip of each of the blades to hold them in place. A ferrule screws onto the rear of the central body and captures the rear tip of each of the blades to hold them in place. This broadhead blade unit can be disassembled into its component parts.

Another example is U.S. Pat. No. 4,928,969 issued to Nagatori, which discloses a broadhead with a replaceable secondary arrow blade received within a slot of the primary arrow blade which is all received within a slotted ferrule. This broadhead can similarly be disassembled into its component parts.

Most of the broadheads in the prior art are punch-type braodheads having a conical tip of some kind. Upon impact with the prey, the conical tip of the broadhead punches through the surface of the skin. After the tip punches through the prey, the trailing, razor sharp blades of the broadhead make contact and provide a cutting action.

While most of the prior art broadheads are designed as the punch-type, the preferred design is a chisel-type broadhead where the razor sharp edges of the blades come together to create the point of the broadhead. As the point impacts the prey, there is a cut on contact action.

U.S. Pat. No. 4,570,941 issued to Saunders discloses a multi-piece broadhead that is designed to provide the preferred cutting action immediately upon impact. A tapered hub has a slot to receive a plurality of blades. The rear of each of the blades is received in a slot at the rear of the hub where it is retained by means of an annular grommet and a belleville washer. When assembled, some of the razor edges meet at a pointed tip which provides the immediate cut on contact action. The other razor edges trail the point of the arrowhead and do not participate in the cut on contact action. The blade unit developed by Saunders can be disassembled to replace the blades or other parts as needed.

BRIEF SUMMARY OF THE INVENTION

This invention is a unitary, chisel-type blade unit for a broadhead comprising multiple blades each with razor edges extending radially from a common frontal point to a base, the base of each blade being connected to a central base collar having a central aperture in alignment with a cap on the underside of each of the blades and positioned between the central base collar and the common frontal point; the cap having a first means for connection to a ferrule; and the central base collar having a second means for connection to a ferrule. The invention further comprises a ferrule having a front portion, a central portion and a rear portion, the front portion having means for connection to the cap, the central portion having means for connection to the central base collar, and the rear portion having means for connection to an arrow shaft.

The multiple razor edges join to form the common frontal point of the blade unit and provide the preferred, immediate cut on contact action. The simple, one-piece design of the blade unit avoids the many pieces and the complex, puzzle-like assembly required by prior art broadheads.

The ferrule of the present invention connects easily to the blade unit on one end and the arrow shaft on the other. The ferrule can be made of different weights and materials allowing the archer to change the weight of the broadhead and to adapt it to the many different hunting situations. The ferrules can be trimmed to remove material and therefore weight from the ferrule should the archer prefer an even lighter weight on the arrow.

The archer can replace either a blade unit or a ferrule as needed. For example, if a blade unit is damaged or needs sharpening, the archer can separate the old blade unit from the ferrule and replace it with a new blade unit while using the same ferrule. Alternatively, an archer can replace just the ferrule, either because it has been damaged in some way, or because a different weight might be desired.

BRIEF DESCRIPTION OF THE SEVERAL VIEWS OF THE DRAWINGS

FIG. 15A shows the angle for the grinding of the blade adjacent to the base. FIG. 15B shows the angle for the grinding of the blade at the common frontal point.

DETAILED DESCRIPTION OF THE INVENTION

Figure 1:
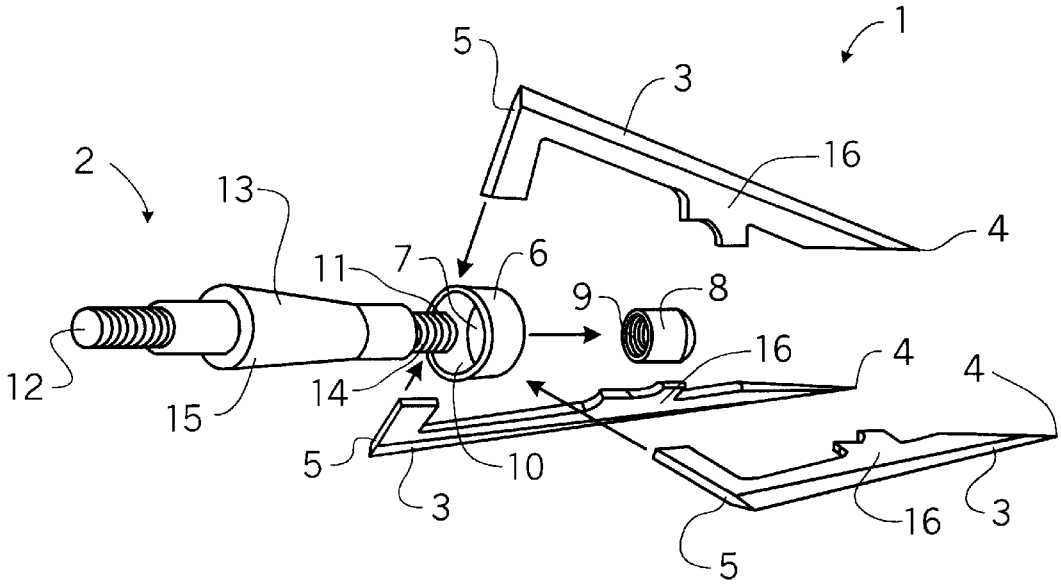
FIG. 1 is an exploded view of the blade unit with a ferrule.
Figure 2:
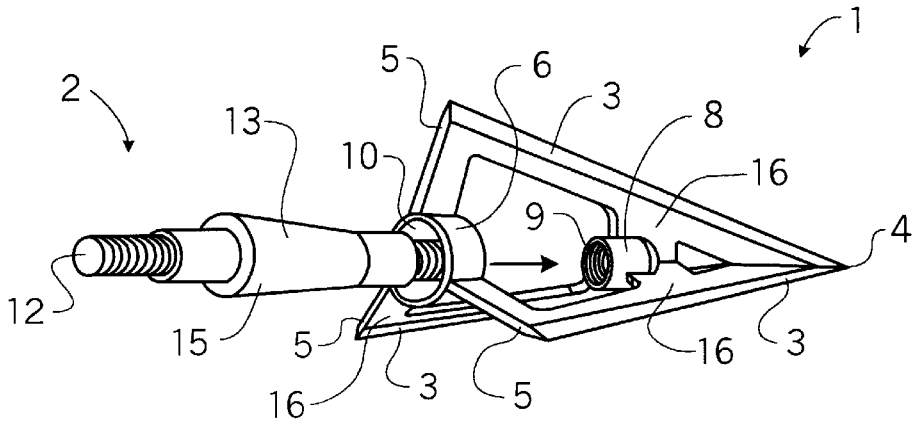
FIG. 2 is a view of the unitary blade unit with a ferrule being positioned into the blade unit but before engagement therewith.

Referring now to the drawings, and most particularly to FIGS. 1 and 2, reference numeral 1 refers to the unitary, chisel-type blade unit for a broadhead. The blade unit 1 connects to a ferrule 2 which has a front portion 11, a rear portion 12, and a central portion 13. The blade unit 1 connects to the ferrule 2 in two areas of the ferrule: at the front portion 11 of the ferrule 2 and at the central portion 13 of the ferrule 2. The rear portion 12 of the ferrule 2 connects to the shaft of an arrow (not shown).

The blade unit 1 comprises multiple blades 16 each having a razor edge 3 that extends radially from a common frontal point 4 to a base 5. The base 5 of each blade 16 is connected to a central base collar 6 having a central aperture 7 in alignment with a cap 8. The cap 8 is on the underside of each of the blades 16. The cap 8 is positioned between the central base collar 6 and the common frontal point 4.

The cap 8 has a first means 9 for connection to a ferrule. This is shown in FIGS. 1 and 2 as being threads on the inside of the cap 8. The front portion 11 of the ferrule 2 has means 14 for connection to the cap. This is shown in FIGS. 1 and 2 as being external threads that screw into and mate with the threads on the inside of the cap 8. The internal threads in the cap can be tapered provided that the external threads on the front portion 11 of the ferrule are appropriately tapered to receive same. Preferably the taper would be from about 2 degrees to about 10 degrees, and more preferably is about 5 degrees. FIGS. 11A, 11B, 11C and 11D show isolated views of the cap and typical dimensions thereof, but without any taper on the threads.

Figure 10:
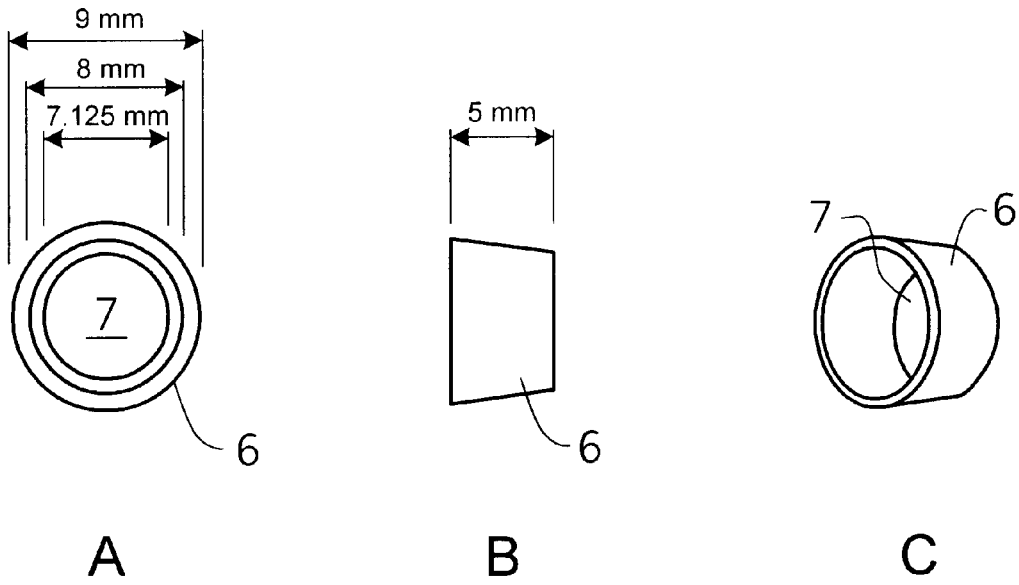
FIG. 10 is three views of the central base collar of the invention, one view A from the end, one view B from the side, and a perspective view C. Typical dimensions are shown.
Figure 11:
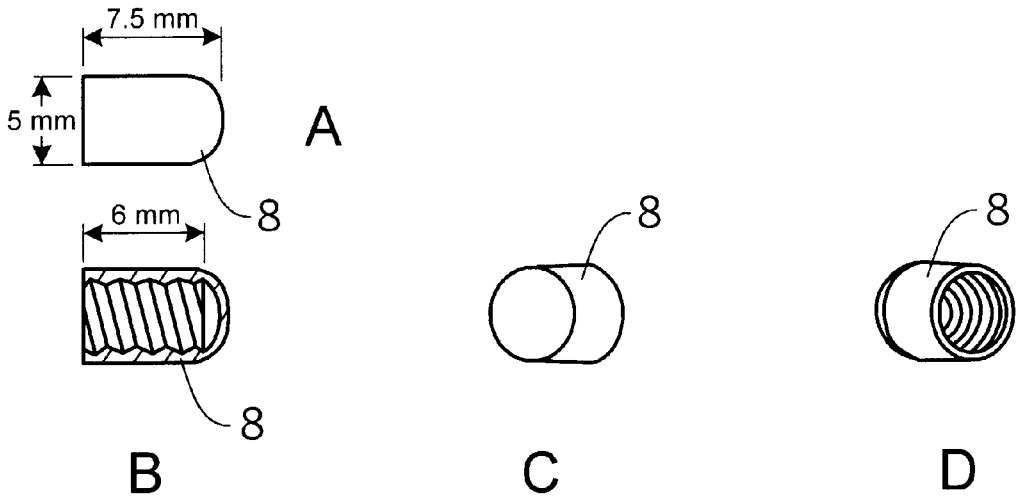
FIG. 11 is four views of the cap of the present invention, one view A from the side, one cutaway view B from the side and showing the threads as they would appear on the inside, a perspective view C of the cap from one end, and a perspective cutaway view D of the cap from the other end showing the internal threads. Some typical dimensions are also shown.

The central base collar 6 has a second means 10 for connection to a ferrule. FIGS. 1 and 2 show the second means 10 for connection to a ferrule as being an internal taper (not threaded). Preferably the internal taper is from about 2 degrees to about 10 degrees, and is more preferably about 5 degrees. FIGS. 10A, 10B and 10C show isolated views of the central base collar 6 and some typical dimensions therefor. The central portion 13 of the ferrule 2 has a means 15 for connection to the central base collar 6. This is shown in FIGS. 1 and 2 as being an external taper. The external taper mates inside of and tightens as a force fit in the central aperture 7 of the central base collar 6.

Figure 18:
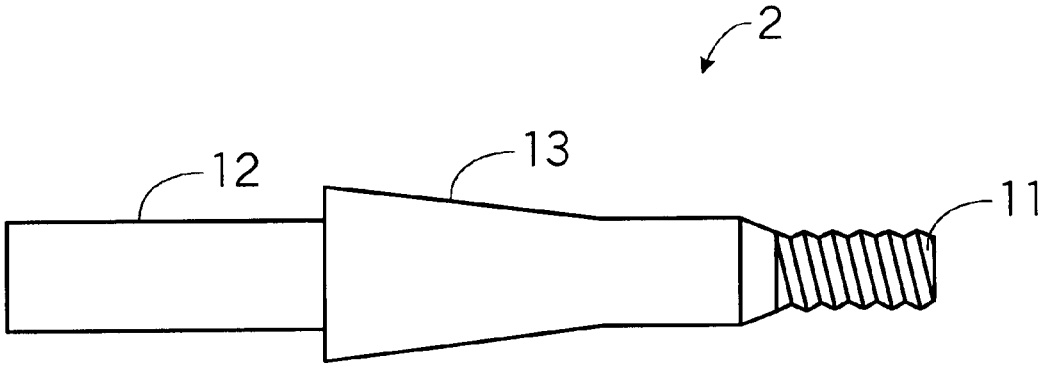
FIG. 18 is a side view of the ferrule with the rear portion being an insert.
Figure 19:
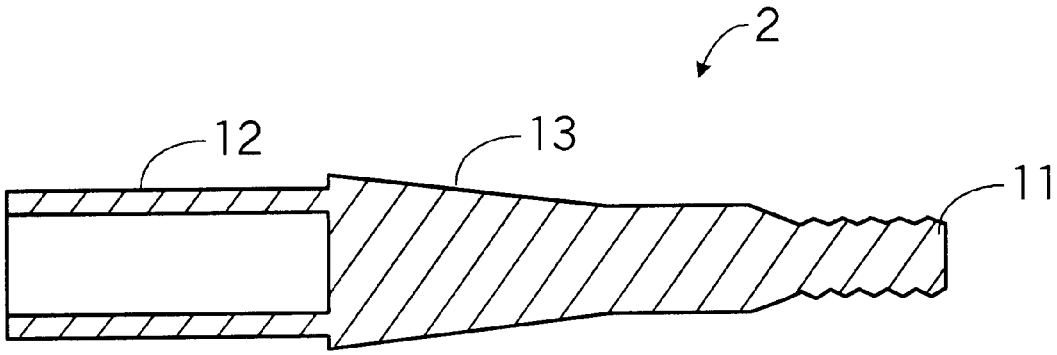
FIG. 19 is a side view cross section of the ferrule with the rear portion being an outsert.

As shown in FIGS. 1 and 2, the front portion 11 of the ferrule 2 is inserted into and through the central aperture 7 of the central base collar 6 of the blade unit 1 until the front portion 11 of the ferrule meets the cap 8. The ferrule 2 is then rotated clockwise such that the front portion 11 of the ferrule 2 screws into the threads on the inside of the cap 8. As the front portion 11 of the ferrule is drawn into and connects with the cap 8, the central portion 13 of the ferrule, which is tapered, is drawn into, mates inside of and tightens in the central aperture 7 of the central base collar 6. By screwing the ferrule 2 tightly into the blade unit 1, a secure connection is made between the ferrule and the blade unit at the two points of connection. The resulting broadhead can be connected to the shaft of an arrow via the rear portion 12 of the ferrule. This can be done in several ways. The rear portion 12 of the ferrule can be screwed into the arrowshaft which would have either an insert or an outsert with appropriate threads to receive said rear portion 12 of the ferrule. An insert is received by and is glued inside an arrow shaft for the purpose of receiving a ferrule. An outsert is received by and is glued over an arrow shaft for the purpose of receiving a ferrule. Such inserts and outserts are well known in the art. In accordance with another embodiment of the present invention, the rear portion 12 of the ferrule can itself be an insert or an outsert designed to be accepted directly by and glued onto the shaft of the arrow. A ferrule 2 having a rear portion 12 designed as an insert is shown in FIG. 18. A ferrule 2 having a rear portion 12 designed as an outsert is shown in FIG. 19.

Figure 3:
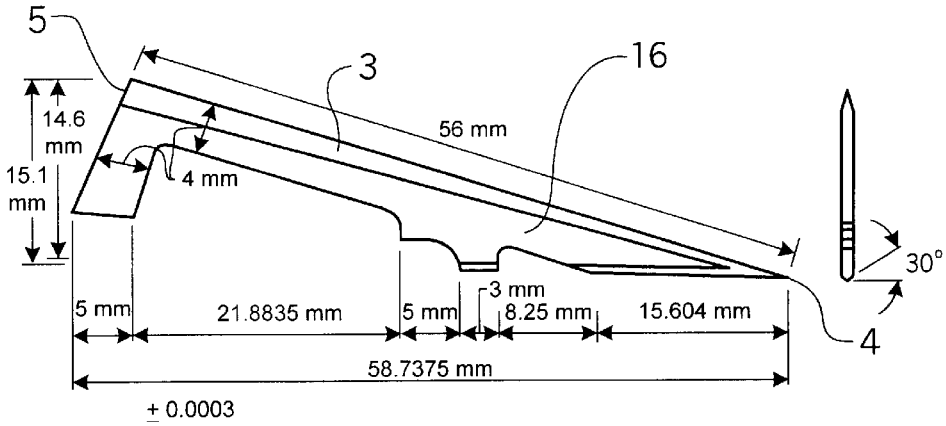
FIG. 3 is a side view of one of the blades with a razor edge, showing typical dimensions thereof.
Figure 4:
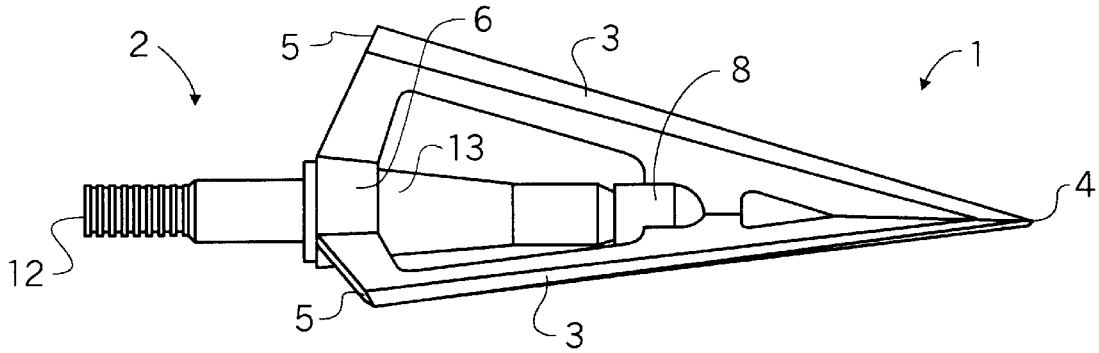
FIG. 4 is a side view of the unitary blade unit connected to a ferrule.

FIG. 4 shows a side view of the broadhead after the ferrule 2 has been connected to the blade unit 1. FIG. 3 shows some typical dimensions of one of the blades 16.

Figure 15:
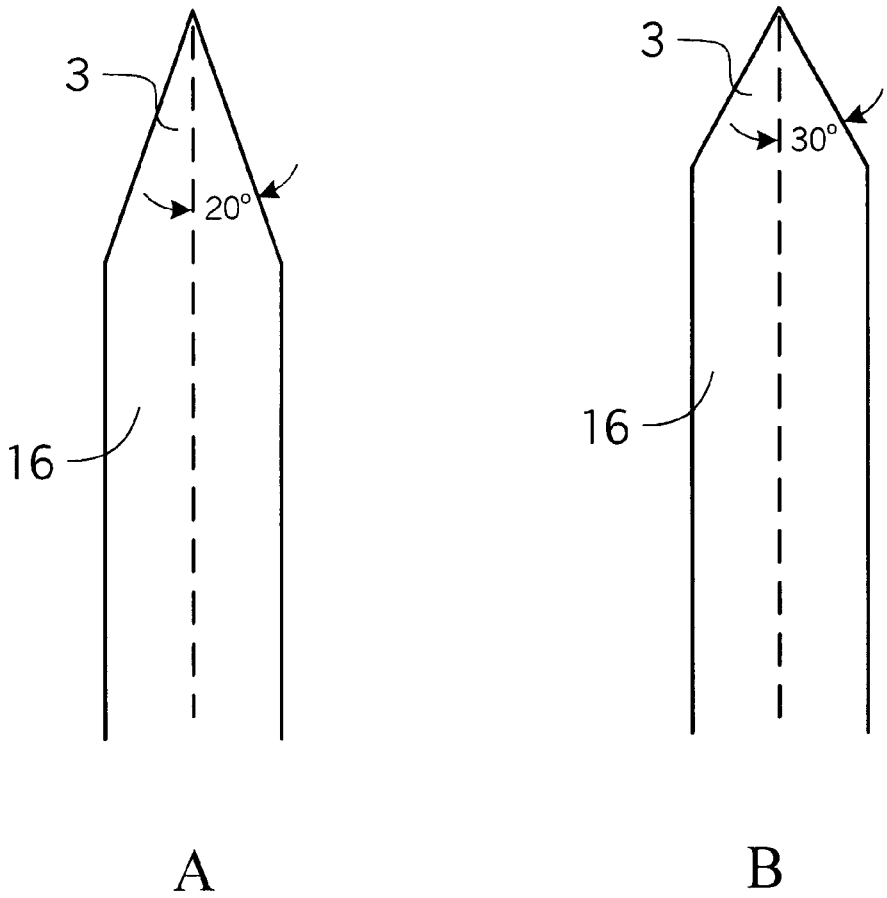
FIGS. 15A and 15B are views of a blade and its razor edges showing different angles for a tapered grinding of a blade.

The common frontal point 4 of the blade unit 1 is the first part of the broadhead that will have contact with the prey. Since it is just a point, and it is receiving a tremendous amount of force upon impact, it is preferred that the front of the blade unit be constructed in such a way that it has additional strength. This can be accomplished by a tapered grinding of each of the razor edges 3, that is each razor edge 3 toward the common frontal point 4 is sharpened at an angle to the vertical that is greater than the angle of the razor edge adjacent to the base 5 of the blade 16. For example, the rear of the blade 3, that is the portion adjacent to the base 5, could be sharpened at an angle of about 20 degrees as shown in FIG. 15A, while that portion of the blade 3 at the common frontal point 4 could be sharpened at an angle greater than 20 degrees and up to 30 degrees as shown in FIG. 15B. The rest of the blade 3 between the common frontal point 4 and the base 5 could then be sharpened as a gradual taper between the two extremes. The tapered grinding can be seen along the entire edge 3 of the blade 16 in FIG. 3. Near the base 5 of the blade 3, the razor edge 3 is wider than it is as it approaches the common frontal point 4.

Figure 5:
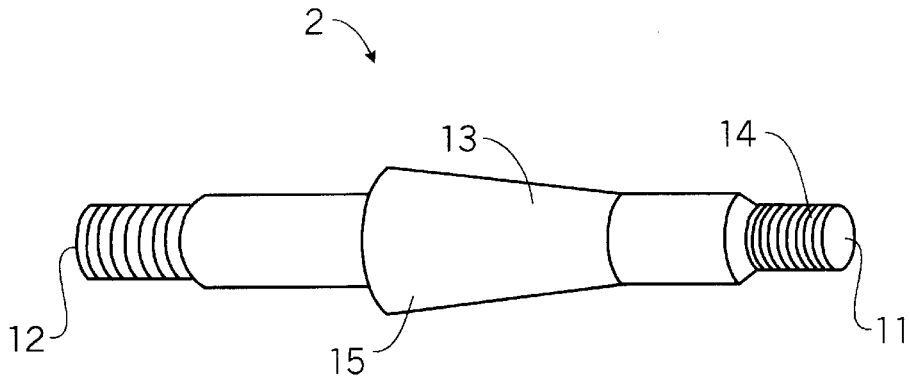
FIG. 5 is a side perspective view of a ferrule of the present invention.
Figure 6:
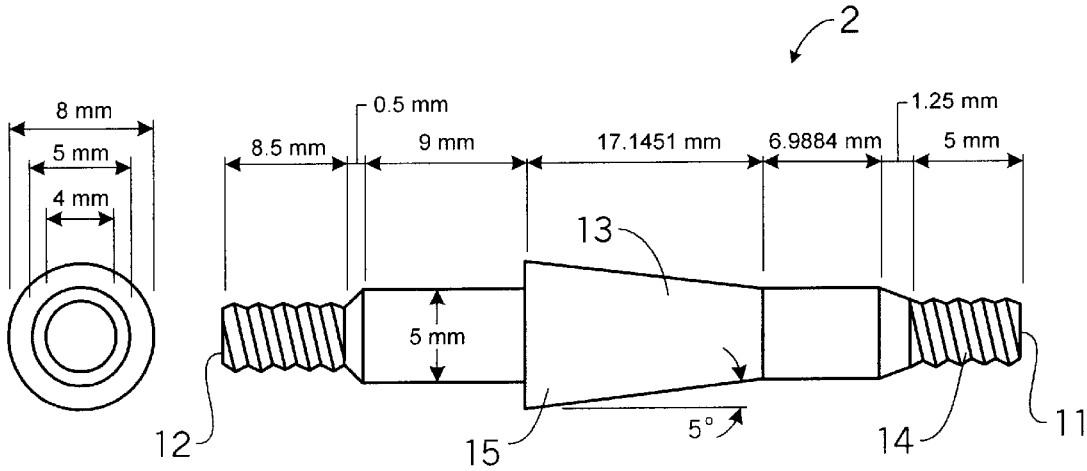
FIG. 6 is a side view of a ferrule of the present invention showing typical dimensions thereof.

FIG. 5 shows an isolated view of a preferred embodiment of the ferrule 2. FIG. 6 shows some typical dimensions for the ferrule 2.

Figure 9:
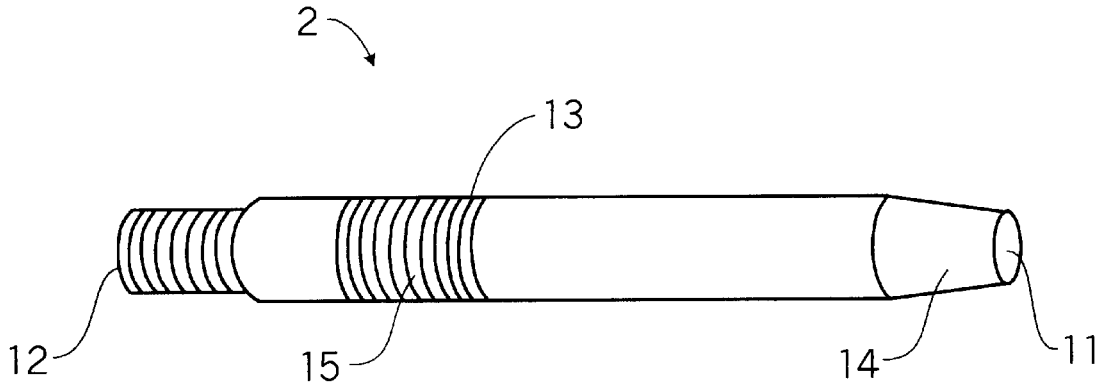
FIG. 9 is a perspective view of a ferrule of the present invention, such ferrule having a front taper and central threads each of which connect to a blade unit of the present invention.
Figure 12:
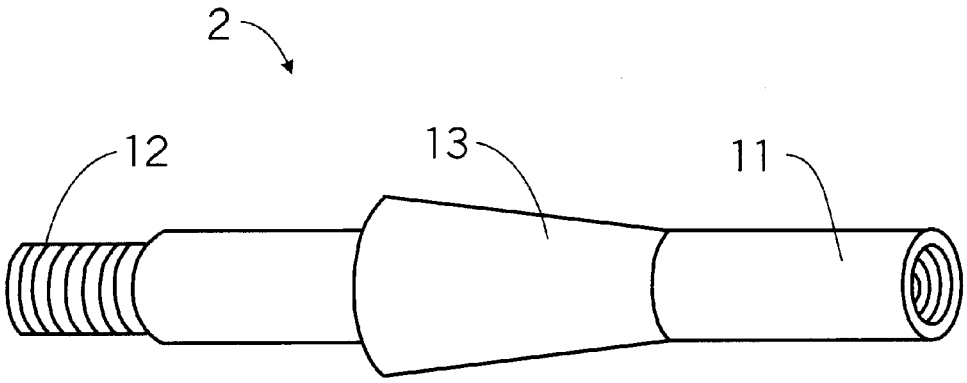
FIG. 12 is a side perspective view of a ferrule of the present invention, such ferrule having internal threads on the front portion thereof and a central taper, both for connection to a blade unit of the present invention.
Figure 13:
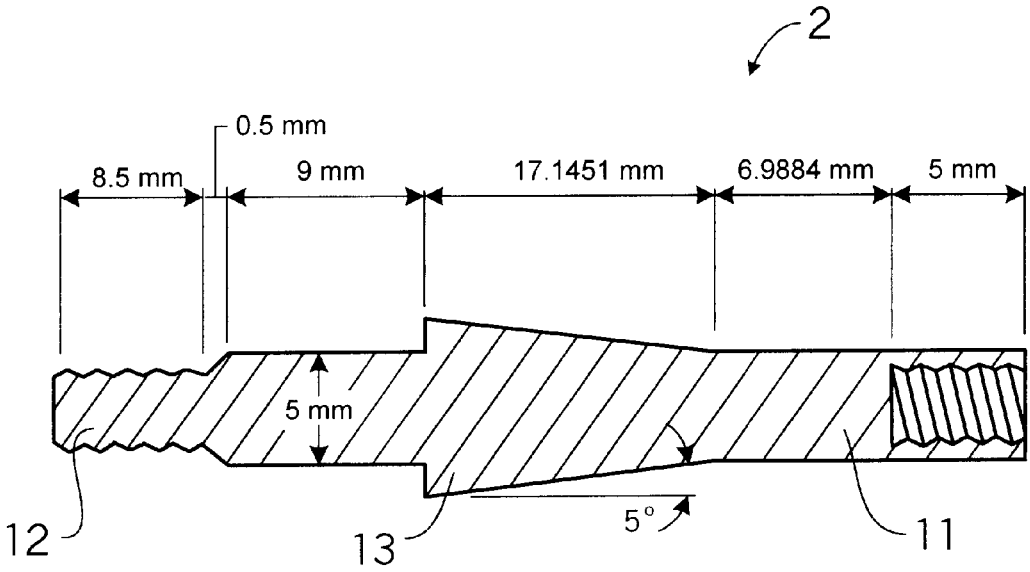
FIG. 13 is a side view cross-section of a ferrule of the present invention showing typical dimensions thereof.
Figure 17:
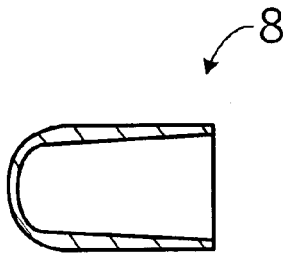
FIG. 17 is a side view cross-section of the cap showing an internal taper.

While the above describes one of the preferred methods of connecting the ferrule 2 to the blade unit 1, it is to be understood that there are many other ways in which the ferrule 2 may be connected to the blade unit 1, all of which are part of my invention. For example, the means 14 for connection of the ferrule to the blade unit 1 may be internal threads (see FIG. 12) that mate with external threads on the outside of the cap 8. Such external threads on the outside of the cap 8 can be seen in FIG. 14. Further for example, all of these threads may be tapered, preferably from about 2 degrees to about 10 degrees, and more preferably about 5 degrees. Still further, for example, the front portion 11 of the ferrule may be unthreaded and tapered as shown in FIG. 9. This would then mate with a cap 8 having an inside taper as shown in FIG. 17. If the front portion 11 of the ferrule is unthreaded and tapered, it is necessary that the central base collar 6 and the central portion 13 of the ferrule 2 be modified from a mating unthreaded taper to mating threads, which can be either tapered or untapered. This is necessary in order to secure the ferrule 2 to the blade unit 1. FIG. 9 shows a ferrule 2 with the central portion 13, where the means 15 for connection of the ferrule 2 to the central base collar 6 is external threads. Such threads would screw into the central base collar which would have internal threads (not shown) to receive and secure same. If the threads are tapered it is preferred that the taper is preferably at an angle of from about 2 degrees to about 10 degrees, and more preferably is at an angle of about 5 degrees.

Figure 16:
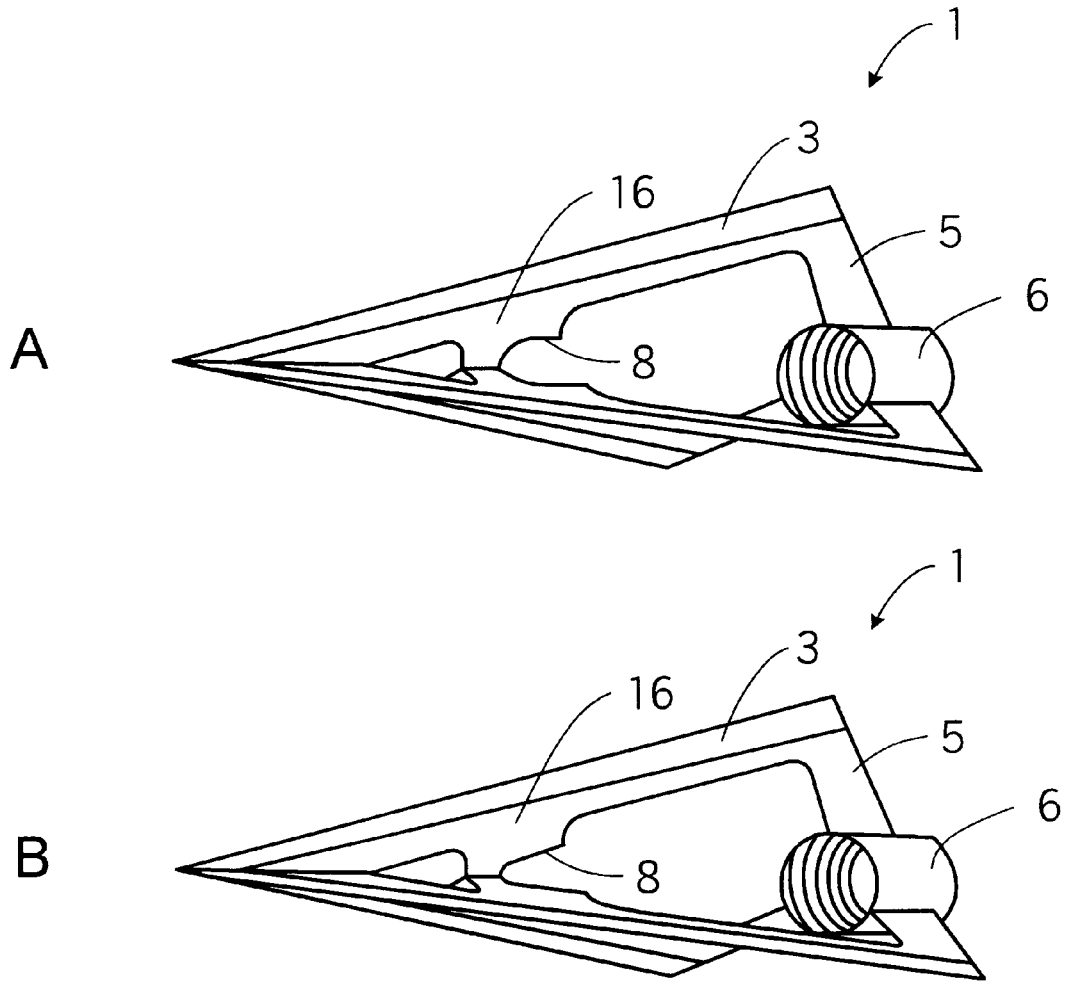
FIGS. 16A and 16B are perspective views of the blade unit having a cap on the underside of the blades, where the cap is formed by the underside of the blades themselves. Two different shapes for the cap are shown.

When using a ferrule 2 having the structure as shown in FIG. 9, it is not necessary that the cap 8 entirely surround the corresponding front portion 11 of the ferrule 2. The cap may be formed by the underside of the blades themselves as shown in FIGS. 16A and 16B. With such a structure, it is necessary is that the cap, however formed, provides a location for the reception and tapered tightening of the front portion of the ferrule inside the cap 8. This can be accomplished by shaping the underside of the blades to form the cap 8 and to receive the front portion 11 of the ferrule.

The blade unit 1 of the present invention is unitary in that once it is made, it cannot be disassembled without destroying the unit. The blade unit may be made by welding, casting, brazing or by metal injection molding. The blade unit can also be made by any other means now known or later developed so long as the process produces a single piece having the structure disclosed herein.

Figure 14:
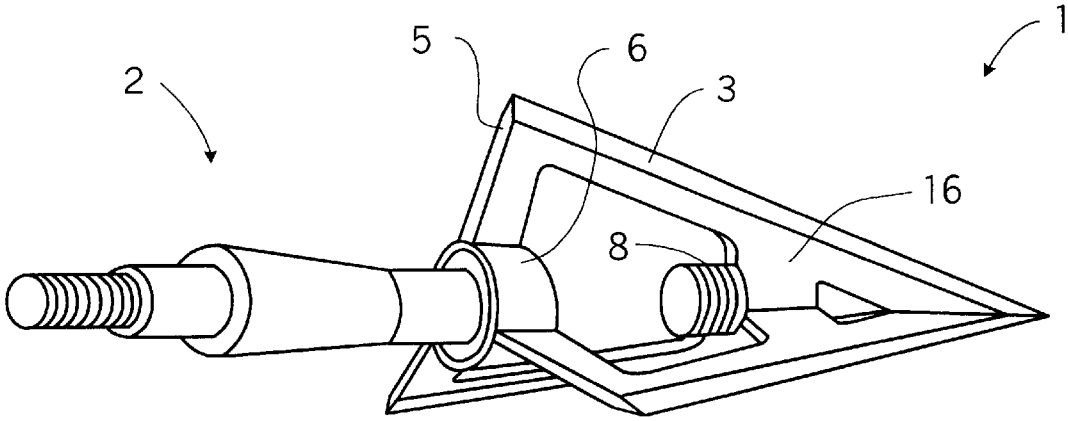
FIG. 14 is a perspective view of the unitary blade unit with a ferrule being positioned into the blade unit but before engagement therewith. The cap is shown as having external threads.

When the blade unit is made by metal injection molding or casting, it is preferred that the first means 8 for connection to a ferrule should be external threads as shown in FIG. 14. The blade unit 1 may be made of any metal, but is preferably made of carbon steel, stainless steel, spring steel, tool steel, or titanium. The ferrule 2 may be made of any metal but is preferably made of aluminum, carbon steel, stainless steel or titanium.

Figure 7:
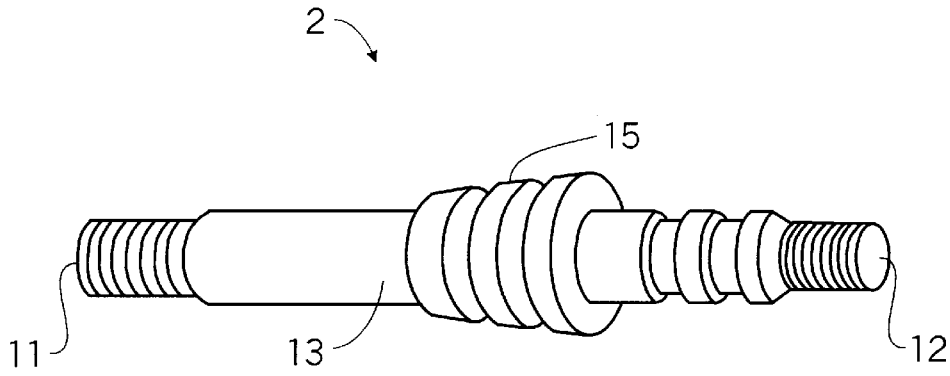
FIG. 7 is a side perspective view of a ferrule of the present invention trimmed to remove material and therefore weight from the ferrule.
Figure 8:
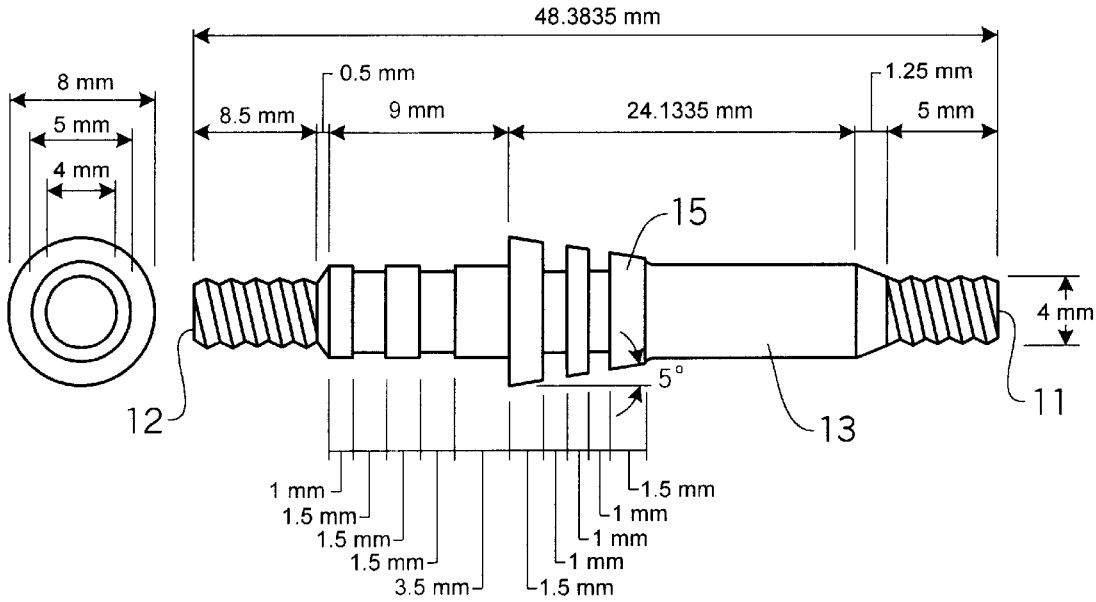
FIG. 8 is a side view of a ferrule of the present invention trimmed to remove material and therefore weight from the ferrule, and showing typical dimensions thereof.

Many hunters prefer specific weights for their broadheads. This invention allows hunters to choose the materials of construction which provides the weight they desire for the situation. Additionally, if a hunter wishes a lighter weight of a certain material, the ferrule may be trimmed to remove material and thus weight from the ferrule. Such a ferrule is shown in FIGS. 7 and 8. FIG. 8 shows typical dimensions that may be used.

While various dimensions in the drawings have specifically been shown, it is not intended that these dimensions be limiting in any way since many other dimensions can be used as desired.

While these embodiments of the present invention have been shown and described, it will be obvious to those skilled in the art that changes and modifications will be made without departing from the invention in its broader aspects. The aim of the appended claims is to cover all such changes and modifications as fall within the true spirit and scope of the invention.

I claim:

1. A unitary, chisel-type blade unit for a broadhead comprising multiple blades each with razor edges extending radially from a common frontal point to a base, the base of each blade being connected to a central base collar having a central aperture in alignment with a cap on the underside of each of the blades and positioned between the central base collar and the common frontal point; the cap having a first means for connection to a ferrule; and the central base collar having a second means for connection to a ferrule.

2. The blade unit of claim 1 wherein the first means for connection to a ferrule is threads on the inside of the cap.

3. The blade unit of claim 2 wherein the threads on the inside of the cap are tapered.

4. The blade unit of claim 1 wherein the first means for connection to the ferrule is threads on the outside of the cap.

5. The blade unit of claim 4 the threads on the outside of the cap are tapered.

6. The blade unit of claim 1 wherein the first means for connection to the ferrule is an internal taper.

7. The blade unit of claim the internal taper is from about 2 to about 10 degrees.

8. The blade unit of claim 6 wherein the internal taper is about 5 degrees.

9. The blade unit of claim 1 wherein the second means for connection to a ferrule is threads on the inside of the collar.

10. The blade unit of claim 9 wherein the threads on the inside of the collar are tapered.

11. The blade unit of claim 1 wherein the second means for connection to a ferrule is an internal taper.

12. The blade unit of claim 11 wherein the internal taper is from about 2 to about 10 degrees.

13. The blade unit of claim 11 wherein the internal taper is about 5 degrees.

14. The blade unit of claim 1 wherein the blade unit is made from a metal selected from a group consisting of stainless steel, carbon steel and titanium.

15. The blade unit of claim 1 made by a process of metal injection molding.

16. The blade unit of claim 1 made by a process of casting.

17. The blade unit of claim 1 having from 2 through 4 blades.

18. The blade unit of claim 1 having 3 blades.

19. The blade unit of claim 1 wherein each of the blades has a tapered grinding.

20. The blade unit of claim 19 wherein each blade at a point adjacent to the base is sharpened to an angle of about 20 degrees and each blade at the common frontal point is sharpened at an angle of greater than 20 degrees and up to 30 degrees.

21. A unitary, chisel-type blade unit for a broadhead comprising three blades each with razor edges extending radially from a common frontal point to a base, the base of each blade being connected to a central base collar having a central aperture in alignment with a cap on the underside of each of the blades and positioned between the central base collar and the common frontal point; the cap having a first means for connection to a ferrule consisting of threads on the inside of the cap; and the central base collar having a second means for connection to a ferrule consisting of an internal taper of about 5 degrees, said blade unit being made by a process of metal injection molding.

22. A broadhead comprising:

a) a unitary, chisel-type blade unit for a broadhead comprising three blades extending radially from a common frontal point to a base, the base of each blade being connected to a central base collar having a central aperture in alignment with a cap on the underside of each of the blades and positioned between the central base collar and the common frontal point; the cap having a first means for connection to a ferrule consisting of threads on the outside of the cap; and the central base collar having a second means for connection to a ferrule consisting of an internal taper of about 5 degrees; and b) a ferrule connectable to said unitary, chisel-type blade unit for a broadhead comprising a front portion connectable to said blade unit, a central portion connectable to said blade unit, and a rear portion having means for connection to an arrow shaft.

23. A unitary, chisel-type blade unit for a broadhead comprising multiple blades each with razor edges extending radially from a common frontal point to a base, the base of each razor edge being connected to a central base collar having a central aperture in alignment with a cap formed by the underside of each of the blades and positioned between the central base collar and the common frontal point; the cap having a first means for connection to a ferrule; and the central base collar having a second means for connection to a ferrule.

24. A ferrule for securing a blade unit to a shaft, comprising:

a threaded connection area adapted to be secured to a threaded area on a blade unit; and a tapered area adapted to be snugly received by a receiving area on the blade unit.

25. The ferrule of claim 24 wherein the ferrule is made from a metal selected from a group consisting of aluminum, stainless steel, carbon steel and titanium.

26. The ferrule of claim 24, wherein the ferrule is trimmed.

27. The ferrule of claim 24 wherein the tapered area includes a taper, wherein the taper is from about 2 degrees to about 10 degrees.

28. The ferrule of claim 24 wherein the tapered area includes a taper, wherein the taper is about 5 degrees.

29. The ferrule of claim 24 wherein said ferrule is trimmed.

30. The ferrule of claim 24 wherein the ferrule does not include a connection area for a blade of the blade unit.

31. The ferrule of claim 24 wherein the ferrule further comprises a shaft connection area adapted to be secured to a shaft.

32. The ferrule of claim 31 wherein the shaft connection area comprises threads adapted to connect the ferrule to the shaft.

33. The ferrule of claim 31, wherein the shaft connection area comprises an outsert adapted to connect the ferrule to the shaft.

34. The ferrule of claim 31 wherein the shaft connection area comprises an insert adapted to connect the ferrule to the shaft.

35. The ferrule of claim 31 wherein the threaded connection area is not adapted to secure the shaft.

* * * * *